US006611983B1

(12) United States Patent
Hopey

(10) Patent No.: US 6,611,983 B1
(45) Date of Patent: Sep. 2, 2003

(54) TOOL FOR DISLODGING PACKED MATERIAL FROM A DISCHARGE CHUTE

(76) Inventor: Thomas A. Hopey, 9889 Moccasin Trail, Wexford, PA (US) 15090

( * ) Notice: Subject to any disclaimer, the term of this patent is extended or adjusted under 35 U.S.C. 154(b) by 192 days.

(21) Appl. No.: 09/632,176

(22) Filed: Aug. 3, 2000

(51) Int. Cl.[7] ..... B08B 9/00; B08B 7/00; B08B 1/00; A47L 13/02; A47L 13/12

(52) U.S. Cl. ..... 15/104.03; 15/104.05; 15/104.068; 15/105; 15/111; 15/236.01; 15/236.05; 15/236.06; 15/236.07

(58) Field of Search ..... 15/104.05, 104.068, 15/104.16, 105, 111, 236.01, 236.04, 236.05, 236.06, 236.07, 236.08, 104.03; 30/169; D21/775; 37/265; 294/61, 126; D4/118; 172/371; D8/11

(56) References Cited

U.S. PATENT DOCUMENTS 332,179 A * 12/1885 Aughe ..... 15/104.09
819,798 A * 5/1906 Ray ..... 294/126
1,699,933 A * 1/1929 Urban ..... 172/371
2,194,336 A * 3/1940 Tullio ..... 294/50.6
3,411,723 A * 11/1968 Kohn ..... 15/236.01
3,487,491 A * 1/1970 Dunn ..... 15/111
4,485,516 A * 12/1984 Crook ..... 15/236.01
5,033,156 A * 7/1991 Stewart ..... 15/105
D363,150 S * 10/1995 Boyer ..... D32/35
5,716,132 A * 2/1998 Chou ..... 366/129
D405,661 S * 2/1999 Erickson ..... D7/688
6,012,227 A * 1/2000 Lent ..... 15/236.01
6,243,906 B1 * 6/2001 Holliday et al. ..... 15/111

* cited by examiner

*Primary Examiner*—Robert J. Warden, Sr.
*Assistant Examiner*—Laura C Cole
(74) *Attorney, Agent, or Firm*—Carothers & Carothers

(57) ABSTRACT

A tool for safely dislodging packed material from a discharge chute which includes an elongated shaft having a handle at one end and a probe tip at the other end. One or more plates depend from one side of the shaft intermediate the ends of the tool. The pointed probe tip is off center with respect to the center line of the shaft in a direction opposite the direction which the plate or plates depend from the shaft. The upper edge of the tool is preferably convex in configuration and may include a brush.

3 Claims, 2 Drawing Sheets

TOOL FOR DISLODGING PACKED MATERIAL FROM A DISCHARGE CHUTE

BACKGROUND OF THE INVENTION

The present invention relates to devices for safely clearing packed material from a discharge chute of a machine without endangering the hands of the operator. While the tool is specifically designed for clearing packed snow from the discharge chute of a snow blower or thrower, it is equally usable for clearing any blocked discharge chute, such as for a lawn mower, chipper-shredder, grain pump, etc.

A common problem is encountered with snow throwers in that the chute which discharges the snow to the side can become compacted and plugged with snow and ice. This is a messy recurring problem that gets the hands and gloves of the user wet and cold. The primary feature of the invention is to make this job easy and neat, allowing the operator to pay attention to quickly and safely removing snow at his work site. A secondary benefit is that of a safety device. Even though sufficient warning is provided on the machine not to use ones hands to dislodge the compacted material, nevertheless, operators continue to have fingers amputated by such machines as they do not follow safety instructions which require that the machine be shut down and the spark plug wire removed before dislodging material from the discharge chute.

As an alternative, operators will utilize a stick to attempt to clear the clogged chute knowing that they will save their fingers should the stick engage the impeller blades of the snow thrower. However, a stick is not efficient for proper removal of such a clog and tends to merely compact the material in the chute more rather than to relieve the problem.

Two types of snow blowers exist in today's market. One is an early production model without operator presence controls, and the more recent production with operator presence control, the later being a handle or bail that engages and disengages the impeller/auger at the users control. The device of the present invention can be used on both types provided safety precautions are followed whereby the unit is turned off, the spark plug is disconnected and the impeller/auger is stopped, or in the second type, the user releases the engagement device and the auger/impeller is stopped. In either case, the device is designed to take the place of the operator's hand in any of the chute cleaning operations, thus helping protect the operator's fingers when the device of the present invention is used properly.

It is accordingly a principal object of the present invention to provide a probe or tool which will easily and safely permit the operator of such equipment to remove packed and clogged material from the discharge chute without having to use the operator's hand directly.

SUMMARY OF THE INVENTION

Two types of snow blowers exist in today's market. One is an early production model without operator presence controls, and the more recent production with operator presence control, the later being a handle or bail that engages and disengages the impeller/auger at the users control. The device of the present invention can be used on both types provided safety precautions are followed whereby the unit is turned off, the spark plug is disconnected and the impeller/auger is stopped, or in the second type, the user releases the engagement device and the auger/impeller is stopped. In either case, the device is designed to take the place of the operator's hand in any of the chute cleaning operations, thus helping protect the operator's fingers when the device of the present invention is used properly.

Thus when the tool is inserted, probe tip first into the clogged chute, the point and the transversely extending plate will penetrate the clog and the tool may be twisted so that when the operator removes the tool the plate will serve to pull clogged material or snow and ice with it.

For safety sake, the handle also includes an annular hand guard so that the hand cannot slip beyond the guard and possibly engage the edges of the discharge chute of the snow throwing device, or similar device.

To assist in the effectiveness of the tool the probe tip is positioned on center with respect to a center line of the tool shaft but the plate depends from the shaft away from the center line. This causes the tip of the probe to penetrate the clogged material in a direction of penetration away from the depending transverse plate so that the penetration of the plate into the clogged material is facilitated.

A second plate depending from the same lower edge of the tool shaft is preferably also provided between the tip and the first plate and extends in substantially the same direction as the first plate. It is also preferable in this arrangement that the extreme distal edge of the second plate be closer to the tool shaft than the extreme distal edge of the first plate to assist in following penetration of the plates into the packed material in the chute. Once substantial penetration has been obtained the tool may be twisted and pulled back and forth to remove large quantities of snow with the plates.

The upper edge of the tool shaft on the side opposite to the plate or plates is also preferably provided in a convex configuration as this curvature assists the effectiveness of the probe tip and also permits the tool to be more readily maneuvered into corners or to outside edges in the chute.

In an alternative variation of the tool of the present invention, a brush may also extend along the upper edge of the tool shaft in a direction opposite to the plate to assist in the chute clearing process. The tool may also be suitably mounted on the machine for easy access.

The tool is preferably made of a suitable plastic such as polypropylene, such that it is durable, yet slightly flexible, for a long service life. It may also be cut out of excess material for casting and manufacturing purposes.

BRIEF DESCRIPTION OF THE DRAWINGS

Other objects and advantages appear hereinafter in the following description and claims. The accompanying drawings show, for the purpose of exemplification, without limiting the invention or appended claims, certain practical embodiments of the present invention wherein:

DETAILED DESCRIPTION OF THE PREFERRED EMBODIMENTS

Figure 1:
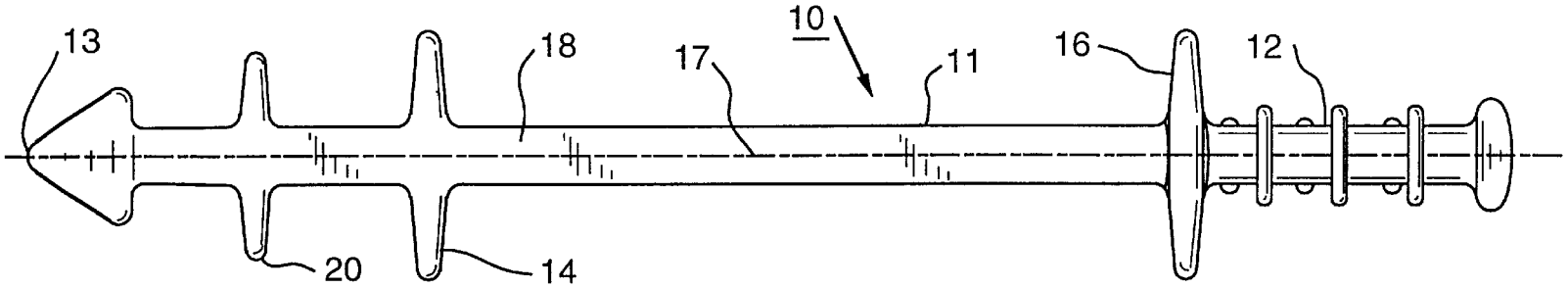
FIG. 1 is a top view of the tool of the present invention for dislodging packed material from a discharge chute.
Figure 2:
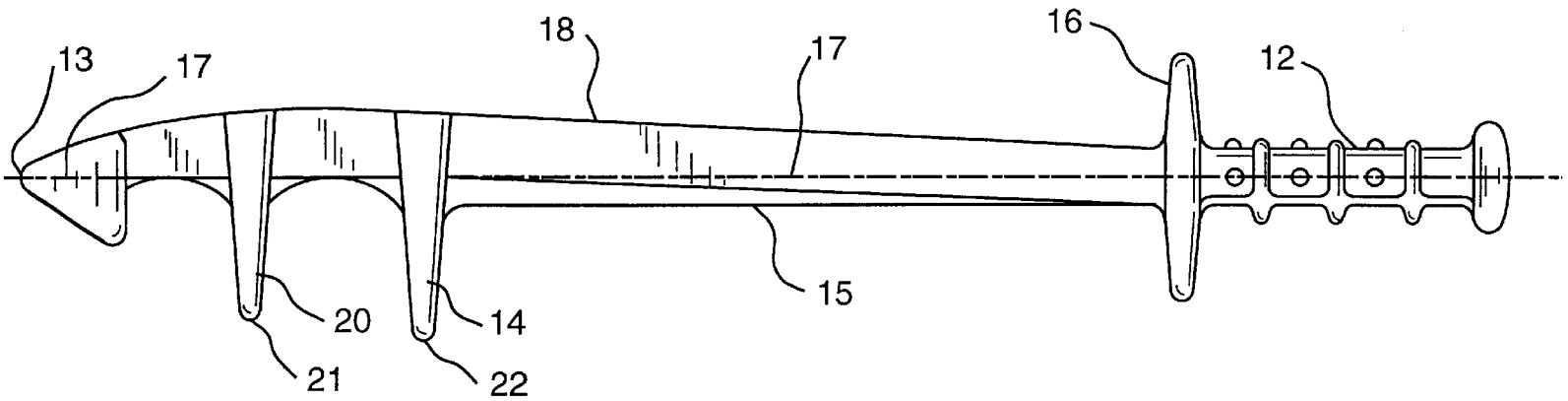
FIG. 2 is a view in side elevation of the tool shown in FIG. 1.

Referring to FIGS. 1 and 2, the tool 10 of the present invention for dislodging packed material from a discharge chute is comprised generally of an elongated shaft 11 having a handle 12 at one end and a pointed probe tip 13 at the other end. A first plate 14 depends from the lower edge 15, in a downward direction as viewed in FIG. 2, intermediate the ends of shaft 11. Handle 12 is also provided with an annular hand guard 16 so that the hand of an operator will not slide or slip down the shaft 11.

The probe tip 13 is positioned on center with respect to center line 17 of shaft 11 and plate 14 depends from shaft 11 away from center line 17.

A second plate 20 depends also from lower edge 15 of shaft 11 between probe tip 13 and the first mentioned plate 14 in substantially the same direction. The extreme distal edge 21 of second plate 20 is closer to the shaft 11 than is the extreme distal edge 22 of the first plate 14. Plates 14 and 20 are circular or oval.

As is best seen in FIG. 2, the upper edge 18 of shaft 11, or the edge which is on the side opposite to that of the plate 14, is made to be convex as illustrated in order to assist maneuvering of the tool probe tip 13 into tight spaces or corners.

Figure 3:
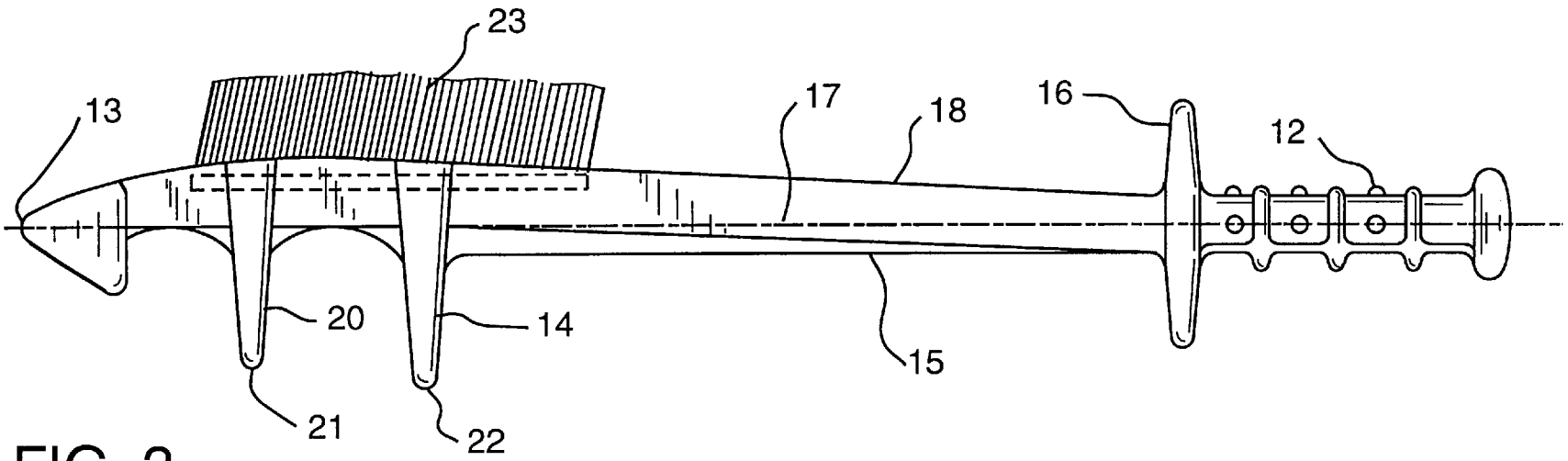
FIG. 3 is a view in side elevation of the tool shown in FIG. 1 illustrating a variation thereof which includes a top mounted brush.

FIG. 3 illustrates another embodiment of the tool of the present invention which is identical in all respects, and is therefore provided with identical reference numerals for part designations, except that the tool shown in FIG. 3 includes a row of bristles 23 which form a brush along the upper edge 18 of the tool to further assist in clearing of clogged material within a discharge chute.

The tool 10 may also be provided with a fastener clip or an eye for hanging the tool on a snow blower machine.

As is illustrated in the top view of FIG. 1 and the side views of FIGS. 2 and 3, plates 14 and 20 have a minimum diameter which is significantly larger than the largest cross sectional dimension of shaft 11 so that the plates can effectively remove packed snow from the chute of a snow blower.

I claim:

1. A tool for safely dislodging packed material from a discharge chute of a snow blower, comprising:

an elongated shaft having an upper and a lower edge and having proximal and distal ends with a handle at said proximal end and a pointed probe tip at said distal end;

said upper edge convexly curved upwardly from said probe tip and said upper edge being without rigid appendages extending upwardly therefrom;

a first plate rigidly secured to and extending downwardly at substantially a right angle from the lower edge of said shaft;

a second plate rigidly secured to and extending downwardly at substantially a right angle from the lower edge of said shaft intermediate said probe tip and said first plate;

said first and second plates each having a minimum diameter which is significantly larger than a largest cross sectional dimension of said shaft; and said second plate having a diameter smaller than that of the said first plate.

2. The tool of claim 1, wherein said handle includes an annular hand guard spaced from the proximal end of said shaft.

3. The tool of claim 1, including a brush extending along said upper edge.

* * * * *